United States Patent [19]

Upchurch

[11] Patent Number: 5,009,181

[45] Date of Patent: Apr. 23, 1991

[54] LINE HANDLING DEVICE

[76] Inventor: Paul E. Upchurch, P.O. Box 1529, Oak Harbor, Wash. 98277

[21] Appl. No.: 551,927

[22] Filed: Jul. 12, 1990

[51] Int. Cl.[5] ..... B63B 21/04

[52] U.S. Cl. ..... 114/230; 114/221 R; 294/19.1

[58] Field of Search ..... 114/230, 221 R; 294/19.1

[56] References Cited

U.S. PATENT DOCUMENTS

| | | | |
|---|---|---|---|
| 149,575 | 4/1874 | Clendaniel et al. | 294/19.1 |
| 2,040,769 | 5/1936 | Fitzgibbon | 114/230 |
| 2,560,622 | 7/1951 | Abramcwski | 43/9 |
| 2,811,127 | 10/1957 | Palsson | 114/230 |
| 3,072,429 | 1/1963 | Stipan | 294/19.1 |
| 3,677,597 | 7/1972 | Stipek | 294/19.1 |
| 3,841,685 | 10/1974 | Kolodziej | 294/19.1 |
| 3,893,005 | 7/1975 | Corbin | 294/19.1 |
| 3,945,335 | 3/1976 | Kratz | 114/230 |
| 4,200,053 | 4/1980 | Vall | 114/230 |
| 4,635,986 | 1/1987 | Johns | 294/19.1 |
| 4,809,635 | 3/1989 | Essig | 114/230 |
| 4,932,700 | 6/1990 | Hart | 114/221 R |

*Primary Examiner*—Sherman Basinger
*Assistant Examiner*—Thomas J. Brahan
*Attorney, Agent, or Firm*—Seed and Berry

[57] ABSTRACT

An apparatus to assist a user in tying a boat to a cleat. The apparatus includes a line having a loop and a pair of spreaders which are independently, slidably mounted thereon. Each spreader has a connection recess to receive an end portion of one of a pair of spaced-apart spreader arms. The spreader arms are attached to one end of an elongated shaft and the other end of the shaft is for grasping by the user. The spreaders hold the loop in an open position for easy placement around the cleat and when the handle is pulled by the user in a direction away from the cleat with a predetermined separation force, with the loop in place around the cleat, the spreaders separate from the spreader arms and the loop is free to assume a closed position around the cleat for tying the boat to the cleat.

42 Claims, 2 Drawing Sheets

FIG. 1
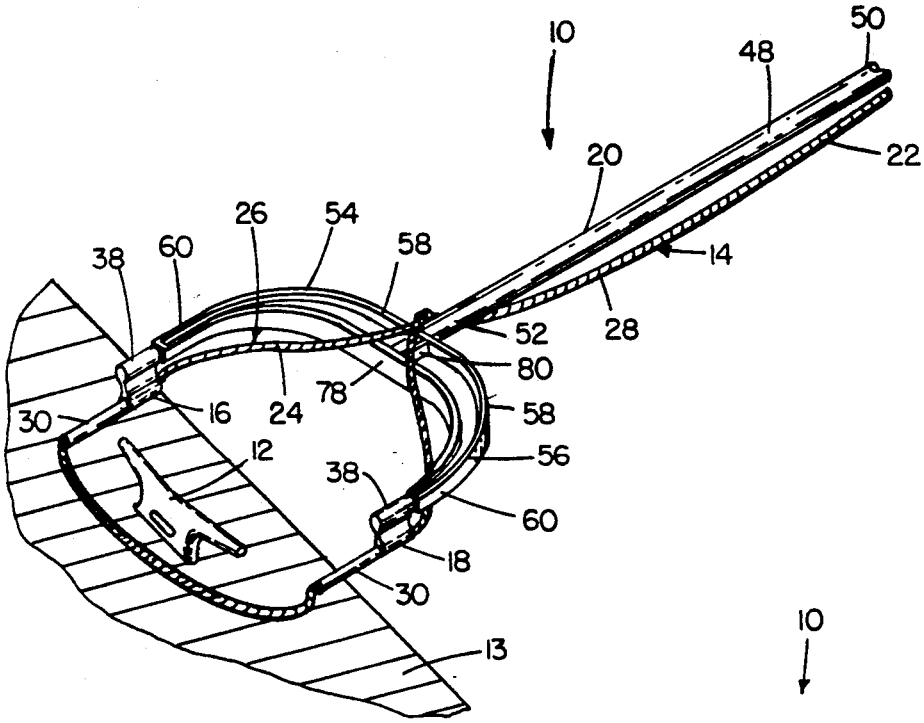
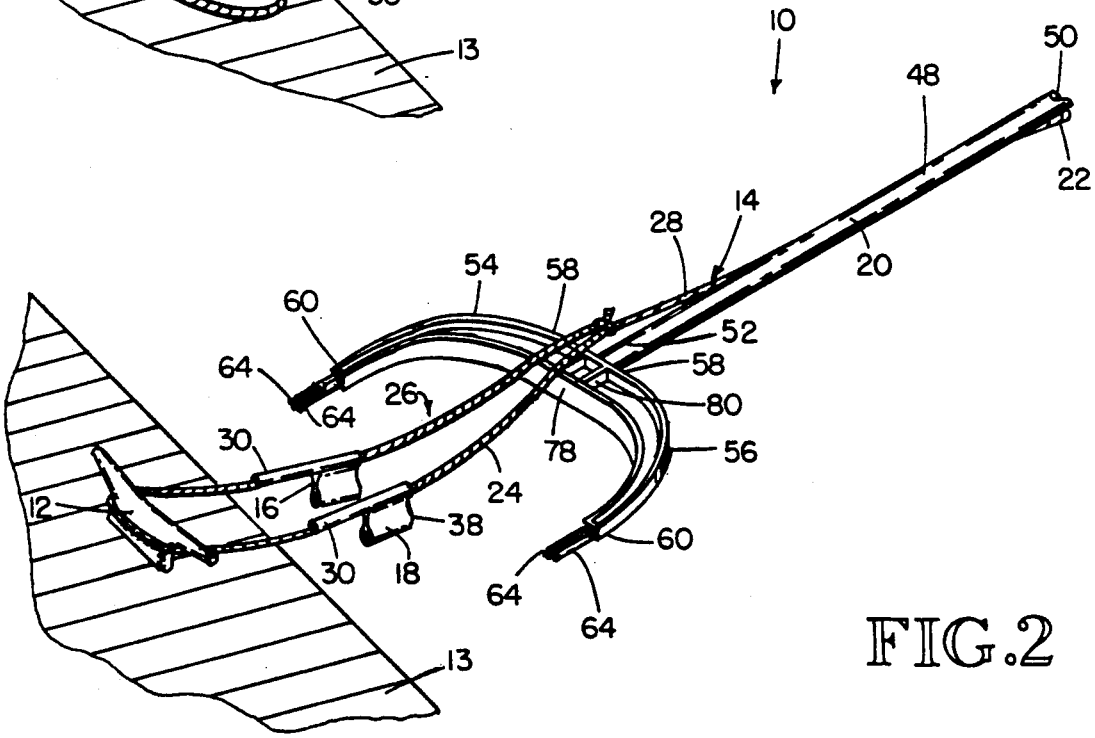
FIG. 2

LINE HANDLING DEVICE

TECHNICAL FIELD

The present invention relates generally to boat line handling apparatus, and more particularly to a device for assisting a boater place a loop of line about a mooring cleat or other object to which a boat is to be moored.

BACKGROUND OF THE INVENTION

Generally, when a boater attempts to moor his boat, he uses a line with a loop at one end. As the boat approaches the dock to which he desires to moor the boat, the boater usually jumps to the dock and places the loop of the line around a mooring cleat. Since it is sometimes not possible to jump from the boat, such as when there is no crew to assist with the mooring, or the size of the boat or the roughness of the water prevents safe jumping from the boat to the dock, or the person handling the line is physically unable to make the jump, it is necessary to throw the loop over the cleat. It takes a high level of skill and usually a great deal of luck to successfully throw the loop over the cleat. Often, multiple throws are required. This can be a time-consuming and frustrating endeavor. If the water is rough, the wind high, or the boat approaching the dock at too high of a speed, it is necessary to very quickly place the loop over the cleat so that the boat can be tied up before the boat collides with nearby boats or the dock.

While various devices have been designed in the past to assist the boater in placing the loop over a cleat or other object to which the boat is to be tied, all such devices have had serious drawbacks. There is a need for an easy-to-use apparatus to assist the boater in tying his boat to a cleat and other objects. Such a device should hold the loop in a very wide-open position to facilitate placement of the loop around the cleat, and then permit quick and easy closing of the loop around the cleat. The device should include a long handle which allows the boater to place the loop over the cleat while on the boat at a substantial distance from the dock. The handle should be disconnectable from the line so that the line can be used for permanent mooring of the boat without replacing it with another line, and without the handle interfering with the final mooring process. The device should securely hold the loop in the open position until the boater is ready to disconnect the handle from the line to prevent the line from accidentally separating from the handle. The device should also be uncomplicated in design, inexpensive to manufacture and convenient to use. The present invention fulfills these needs, and further provides other related advantages.

SUMMARY OF THE INVENTION

The apparatus of the present invention in the preferred embodiment includes a line having a first end portion attachable to the boat, a second end portion forming a loop positionable around the object to which the boat is to be moored, such as a cleat or piling, and a length of line extending between the first and second end portions. Alternatively, an existing looped line can be used with the invention.

The apparatus further includes first and second spreaders. Each of the spreaders is disconnected from the other and has an aperture through which the second end portion of the line extends to mount the first and second spreaders thereon at opposite sides of the loop.

In the preferred embodiment, the spreaders are slidably mounted on the line.

In the preferred embodiment of the invention, the apparatus also includes a handle having a shaft with a proximal end portion for grasping by the user and a distal end portion. Alternatively, an existing handle or boat hook can be used.

The apparatus has a pair of spreader arms, with each spreader arm having one end rigidly attached to the shaft distal end portion and a free end spaced apart from the free end of the other of the spreader arms by a predetermined distance. The free end of each of the spreader arms is releasably connected to a different one of the first and second spreaders, with the first and second spreaders positioned to opposite sides of the loop and spaced apart by about the predetermined distance. This selectively holds the loop in an open position. In the preferred embodiment, the free ends of the spreader arms are selectively disconnectable from the first and second spreaders in response to the user pulling the handle in a direction away from the object with a predetermined separation force with the loop in place around the object. This allows the loop to assume a closed position around the object uninhibited by the first and second spreaders or the spreader arms. Alternatively, other means for disconnecting the first and second spreaders from the spreader arms may be utilized.

With the present invention, the user, while located at a distance from the object and holding the proximal end of the shaft, can easily place the loop around the object. He can then selectively disconnect the first and second spreaders from the spreader arms by pulling on the handles so the loop can assume a closed position around the object for tying the boat to the object.

The first and second spreaders each has an elongated line-retaining member with first and second longitudinal ends spaced apart by a predetermined amount. The aperture through which the second end portion of the line passes extends fully between the first and second member ends. The spreader arms are oriented relative to each other to hold the line-retaining members in a spaced-apart, substantially parallel alignment. The first member ends are positioned toward the spreader arms, and the second member ends are positioned away from the spreader arms when the free ends of the spreader arms are inserted within a corresponding recess of the first and second spreaders. In this manner, the loop is held open in the direction from the first member end to the second member end by a least the predetermined amount.

The first and second spreaders also include an elongated engagement member the first and second longitudinal ends. The recesses each are a longitudinally extending cavity with an opening at the first engagement member end toward the spreader arms. The free ends of the spreader arms are each an elongated insertion member sized to be inserted into one of the openings of the engagement members and to be tightly retained within the recess. Each of the engagement members is rigidly connected to one of the line-retaining members in substantially parallel alignment therewith. The line-retaining members project beyond the engagement members to which connected to position the second ends of the line retaining members beyond the second engagement member ends.

In the preferred embodiment, the free ends of the spreader arms are formed with a pair of resilient fingers sized to be inserted into one of the recesses by yielding movement of the fingers together. The fingers can also include a detent engaging one of the spreaders when the fingers are inserted into the recesses.

Other features and advantages of the invention will become apparent from the following detailed description, taken in conjunction with the accompanying drawings.

BRIEF DESCRIPTION OF THE DRAWINGS

FIG. 1 is a perspective view of the apparatus embodying the present invention, showing the apparatus with a mooring line loop placed around a cleat.

FIG. 2 is a perspective view of the apparatus of FIG. 2, shown with the loop in a closed position around the cleat.

DETAILED DESCRIPTION OF THE INVENTION

Figure 3:
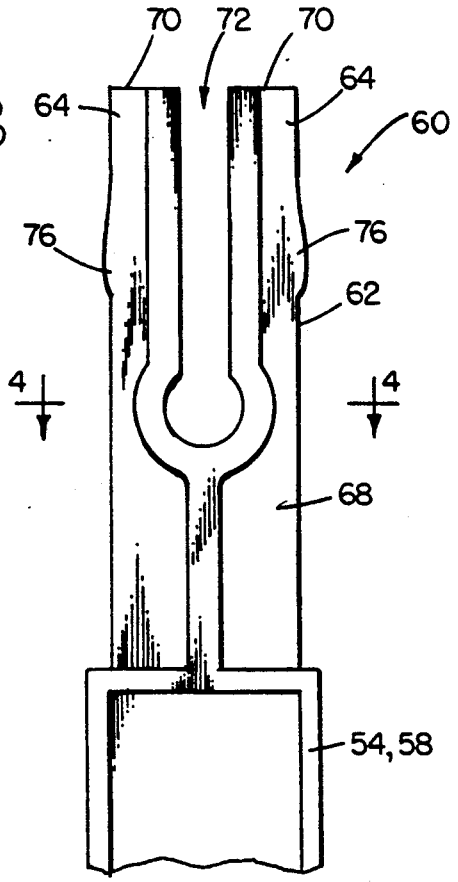
FIG. 3 is an enlarged, fragmentary view of one free end portion of a spreader arm of the invention shown in FIG. 1.

As shown in the drawings for purposes of illustration, the present invention is embodied in an apparatus, indicated generally by reference numeral 10, to assist a user in tying a boat (not shown) to a cleat 12 fixed to a dock 13 or to other objects, such as a piling. The apparatus 10 includes a line 14, first and second spreaders 16 and 18, respectively, and a handle 20 to which the first and second spreaders are removably attached. As will be described in more detail below, the handle can be grasped by the user to assist him in placing the line around the cleat 12 without leaving the boat when the boat is still a distance from the dock 13.

The line 14 has a first end portion 22 attachable to the boat a second end portion 24 forming a loop 26 sized to be placed around the cleat 12, and a length of line 28 extending between the first and second end portions.

Figure 5:
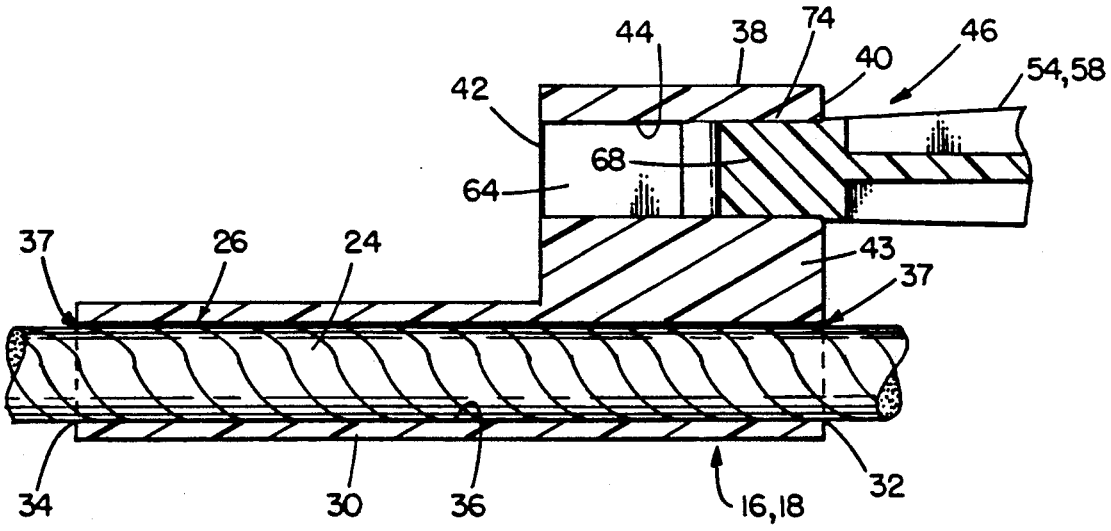
FIG. 5 is an enlarged, elevational cross-section of one of the spreaders shown in FIG. 1.

Each of the first and second spreaders 16 and 18 is disconnected from the other so as to be separately movable. As shown in more detail in FIG. 5, each spreader includes an elongated, tubular, line-retaining member 30 with first and second longitudinal ends 32 and 34, respectively, which are spaced apart by a predetermined amount. An aperture 36 extends fully between the line-retaining member first and second ends 32 and 34 to provide an opening 37 at the first and second ends of each of the first and second spreaders through which the second end portion 24 of the line 14 passes. The aperture 36 is sized to slidably receive therethrough the second end portion 24 of the line. With this arrangement, each of the first and second spreaders 16 and 18 is independently, slidably mounted on the second end portion 24 of the line which forms the loop 26 so that the first and second spreaders can be selectively moved to opposite sides of the loop for connection to the handle 20.

The first and second spreaders 16 and 18 also each includes an elongated, tubular engagement member 38 with first and second longitudinal ends 40 and 42, respectively. The engagement member 38 is fixedly attached to the corresponding retaining member 30 of the spreader by a support rib 43 which holds the engagement member in a substantially parallel, spaced-apart, fixed relation to the line-retaining member. A connection recess 44 extends longitudinally from the engagement member first end 40 at least partially to the engagement member second end 42 to provide a longitudinally extending cavity with an opening 46 at the engagement member first end 40.

The handle 20 includes an elongated shaft 48 with a proximal end portion 50 for grasping by the user and a distal end portion 52. A pair of spreader arms 54 and 56 each have one end 58 rigidly attached to the shaft distal end portion 52 and a free end 60 spaced apart from the free end of the other of the spreader arms by a predetermined distance. In the preferred embodiment of the invention, the free ends 60 of the spreader arms 54 and 56 are each releasably insertable into the recess 44 of a different one of the first and second spreaders 16 and 18 when the first and second spreaders are positioned to opposite sides of the loop 26 and spaced apart by about the predetermined distance for the spreader arms. In this manner, the spreader arms 54 and 56 selectively hold the loop 26 in an open position.

The free ends 60 of the first and second spreader arms 54 and 56 are releasable from the recesses 44 of the first and second spreaders 16 and 18 in response to the user pulling the handle 20 in a direction away from the cleat 12 with the loop 24, when held in an open position, in place around the cleat. When a predetermined separation force is exceeded, the free ends 60 of the spreader arms 54 and 56 will be released from the recesses 44 of the first and second spreaders 16 and 18, and allow the loop 26 to assume a closed position around the cleat uninhibited by the first and second spreaders or by the spreaders arms, as shown in FIG. 2. In such manner, the user can easily place the loop 26 around the cleat 12 and selectively disconnect the first and second spreaders 16 and 18 from the spreader arms 54 and 58 while still standing on the boat by pulling on the proximal end portions of the shaft 48 so the loop can assume a closed position around the cleat for tying the boat to the cleat.

Figure 4:
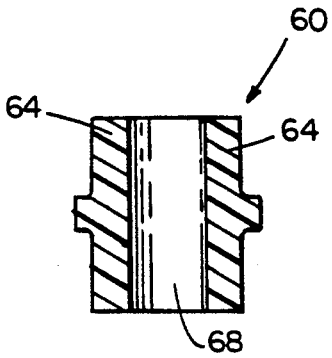
FIG. 4 is a sectional view taken substantially along the lines 4—4 of FIG. 3.

In the preferred embodiment of the invention, as best shown in FIGS. 3 and 4, the free ends 60 of the spreader arms 54 and 56 are each sized to be inserted into the opening 46 of one of the engagement members 38 and to be tightly retained within the recess 44. The spreader arms 54 and 56 are oriented relative to each other to hold the line-retaining members 30 of the first and second spreaders 16 and 18 in a spaced-apart, substantially parallel alignment having their first ends 32 positioned toward the spreader arms and their second ends 34 positioned away from the spreader arms when the free ends 60 of the spreader arms are inserted within the recesses 44 of the first and second spreaders. The first end 40 of the engagement member 38 at which the openings 46 of the recesses 44 are located is positioned toward the corresponding one of the spreader arms 54 and 56. As such, the loop 26 is held open in the direction from the first end 32 to the second end 34 of the line-retaining members 30 by at least the predetermined amount the first and second ends are spaced apart.

The line-retaining member 30 projects from its first end 32, which is also positioned toward the spreader arm, a desired distance beyond the engagement member second end 42 and terminates at its line-retaining member second end 34 to position the line-retaining member second end of each of the first and second spreaders 16 and 18 beyond the engagement member second ends 42.

By elongating the line-retaining members 30, the opening of the loop 26 is increased by the desired distance in the direction the user will typically reach with the apparatus 10 when attempting to place the loop 26 around the cleat 12 when the boat is at a distance from the dock 13. The spacing between the first and second spreaders 16 and 18 is determined by the spacing between the free ends 60 of the spreader arms 54 and 58. This determines the width of the loop 26.

In the preferred embodiment of the invention, each of the free ends 60 of the spreader arms 54 and 56 is formed as a pair of resilient fingers 64 which are attached together at a common base portion 68. Each of the fingers 64 has a free end portion 70. The fingers 64 are spaced apart by a lateral distance 72 along their full length. The fingers 64 are sized and spaced apart to be insertable into the recess 44 of the engagement member 38 of the corresponding one of the first and second spreaders 16 and 18. The fingers 64 are sufficiently resilient to allow yielding movement of the fingers together when inserted into the recess 44, but have sufficient resiliency to move the fingers apart once inside the recess to resiliently grasp an interior wall 74 of the recess to prevent removal of the fingers therefrom until the predetermined separation force is exerted thereon. In the presently preferred embodiment, each of the fingers 64 has a detent 76 which engages the interior wall 74 of the recess 44 when the fingers are inserted therein.

It is to be understood that other means may be used to permit selective disconnection of the first and second spreaders 16 and 18 from the spreader arms 54 and 56, such as a latch or other locking mechanism which can be activated by the user in any convenient manner.

It is desirable to prevent rotation of the first and second spreaders 16 and 18 on the spreader arms 54 and 56 when the free ends 60 of the spreader arms are inserted into the recesses 44 of the engagement members 38. To accomplish this, the interior wall 74 of the recesses 44 has a non-symmetrical rectangular cross-section, and the free ends 60 of the spreader arms 54 and 56 each has a cross-sectional shape and size to engage the interior wall 74 and prevent rotation of the spreader arms when within the recesses. In the presently preferred embodiment of the invention, the free ends 60 of the spreader arms have a generally rectangular cross-section as shown in FIG. 4, which corresponds to the rectangular cross-section of the recesses 44.

The shaft 48 and the spreader arms 54 and 56 are removably attached together so that the handle 20 can be broken down into at least two parts for storage. In the preferred embodiment, the spreader arms 54 and 56 have, in combination, a "U" shape with a base portion 78. The shaft distal end portion 52 is removably attached to the spreader arms 54 and 56 at the base portion 78 by a snap coupling 80. The base portion 78 includes an insert (not shown) which can be snapped into place within a recess (not shown) in the shaft distal end portion 52, and selectively removed in a conventional manner when the user decides to break the handle down.

With the present invention, the user can quickly and more reliably, in a safer manner and with less effort, accomplish placing the loop 26 of the line 14 around the cleat 12 for mooring purposes while the boat is at a distance from the dock 13 using the long reach provided by the handle 20 of the apparatus 10. The user no longer has to jump to the dock or attempt to lasso the cleat. The operation of the apparatus 10 is simple and requires no training or special skills. Further, the apparatus 10 of the present invention has an uncomplicated construction and can be manufactured in an economical manner. The apparatus 10 can also be broken down for easy storage.

The apparatus 10 can be sold for use with an already existing line provided by the user so that the user simply needs to buy the first and second spreaders 16 and 18 and place them on the loop of the mooring line he already owns, and buy the handle 20 having the spreader arms 54 and 56. Alternatively, the spreader arms 54 and 56 can be manufactured for connection to a handle, boat hook or other pole already owned by the user. In any event, when assembled, the utilitarian features of the resulting device will be substantially as described and shown herein. It will be appreciated that, although a specific embodiment of the invention has been described herein for purposes of illustration, various modifications may be made without departing from the spirit and scope of the invention. Accordingly, the invention is not to be limited except as by the appended claims.

What is claimed is:

1. An apparatus to assist a user in tying a boat to an object, comprising:

a line having a first end portion attachable to the boat, a second end portion forming a loop positionable around the object, and a length of line extending between said first and second end portions;

first and second spreaders, each said spreader being disconnected from the other and having an aperture through which said second end portion of said line extends to independently, slidably mount said first and second spreaders thereon for selected movement of said first and second spreaders to opposite sides of said loop, each said spreader further having a connection recess; and a handle having an elongated shaft with a proximal end portion for grasping by the user and a distal end portion, and further having a pair of spreader arms, each spreader arm having one end rigidly attached to said shaft distal end portion and a free end spaced apart from said free end of the other of said spreader arms by a predetermined distance, said free end of each of said spreader arms being releasably insertable into said recess of a different one of said first and second spreaders with said first and second spreaders positioned to opposite sides of said loop and spaced apart by about said predetermined distance to selectively hold said loop in an open position, said free ends of said spreader arms being releasable from said recesses of said first and second spreaders in response to the user pulling said handle in a direction away from the object with a predetermined separation force with said loop in place around the object to allow said loop to assume a closed position around the object uninhibited by said first and second spreaders or said spreader arms, whereby the user, while located at a distance from the object and holding said proximal end portion of said shaft, can easily place said loop around the object, and the user can selectively disconnect said first and second spreaders from said spreader arms by pulling on said handle so said loop can assume a closed position around the object for tying the boat to the object.

2. The apparatus of claim 1 wherein said first and second spreaders each has an elongated line retaining member with first and second longitudinal ends spaced apart by a predetermined amount, and wherein said aperture extends fully between said first and second member ends, said spreader arms being oriented relative to each other to hold said line retaining members in a spaced-apart, substantially parallel alignment with said first member ends positioned toward said spreader arms and said second member ends positioned away from said spreader arms when said free ends of said spreader arms are inserted within said recesses of said first and second spreaders, whereby said loop is held open in the direction from said first member end to said second member end by at least said predetermined amount.

3. The apparatus of claim 2 wherein said first and second spreaders each has an elongated engagement member with first and second longitudinal ends, said recesses each being a longitudinally extending cavity with an opening at said first engagement member end toward said spreader arms, said free ends of said spreader arms each being an elongated insertion member sized to be inserted into one of said openings of said engagement member cavities and to be tightly retained therein, each of said engagement members being rigidly connected to one of said line retaining members in substantially parallel alignment therewith, said line-retaining members projecting beyond said engagement members to which connected to position said second ends of said line-retaining members beyond said second engagement member ends.

4. The apparatus of claim 1 further including attachment detents which prevent disconnection of said first and second spreaders from said spreader arms until said predetermined separation force has been exceeded by the user pulling on said handle with said loop around the object.

5. The apparatus of claim 1 wherein each of said free ends of said spreader arms is formed as a pair of resilient fingers sized to be insertable into one of said recesses by yielding movement of said fingers together, and having sufficient resiliency to move said fingers apart once inside said recess to resiliently grasp an interior wall of said recess to prevent removal therefrom until said predetermined separation force is exerted thereon.

6. The apparatus of claim 5 wherein at least one of said fingers of each said spreader arms includes a detent engaging one of said first and second spreaders when said fingers are inserted into said recesses.

7. The apparatus of claim 1 further including alignment means for preventing rotation of said first and second spreaders about said spreader arms when inserted in said recesses.

8. The apparatus of claim 7 wherein said alignment means includes said recesses having an interior wall with a non-symmetrical cross-section and said free ends of said spreader arms having a cross-sectional shape and size to engage said interior wall and prevent rotation of said spreader arms when within said recesses.

9. The apparatus of claim 1 wherein said shaft and said spreader arms are removably attached together, whereby when not in use said handle can be broken down into at least two parts for storage.

10. The apparatus of claim 1 wherein said spreader arms have, in combination, a U-shape with a base portion and said shaft distal end portion is attached to said spreader arms at said base portion.

11. An apparatus to assist a user in tying a boat to an object, comprising:

a line having a first end portion attachable to the boat, a second end portion forming a loop positionable around the object, and a length of line extending between said first and second end portions;

first and second spreaders, each said spreader being disconnected from the other and having an aperture through which said second end portion of said line extends to mount said first and second spreaders thereon at opposite sides of said loop;

a handle having a shaft with a proximal end portion for grasping by the user and a distal end portion, and further having a pair of spreader arms, each spreader arm having one end rigidly attached to said shaft distal end portion and a free end spaced apart from said free end of the other of said spreader arms by a predetermined distance, said free end of each of said spreader arms being releasably connectable to a different one of said first and second spreaders with said first and second spreaders positioned to opposite sides of said loop and spaced apart by about said predetermined distance to selectively hold said loop in an open position; and a pair of selectively releasable couplings connecting said free ends of said spreader arms to said first and second spreaders, said couplings being releasable in response to the user pulling said handle in a direction away from the object with a predetermined separation force with said loop in place around the object to separate said spreader arms from said first and second spreaders and allow said loop to assume a closed position around the object, whereby the user, while located at a distance from the object and holding said proximal end portion of said shaft, can easily place said loop around the object, and the user can selectively disconnect said first and second spreaders from said spreader arms by pulling on said handle so said loop can assume a closed position around the object for tying the boat to the object.

12. The apparatus of claim 11 wherein said first and second spreaders each has an elongated line retaining portion with first and second longitudinal ends spaced apart by a predetermined amount, and wherein said aperture extends fully between said first and second ends, said spreader arms being oriented relative to each other to hold said line retaining portions in a spaced-apart arrangement with said first ends positioned toward said spreader arms and said second ends positioned away from said spreader arms when said free ends of said spreader arms are connected to said first and second spreaders, whereby said loop is held open in the direction from said first ends to said second ends.

13. The apparatus of claim 12 wherein said couplings include an elongated engagement portion having a longitudinally extending cavity with an opening rigidly connected to each of said first and second spreaders, said free ends of said spreader arms each being an elongated insertion member sized to be inserted into one of said engagement portion cavities and to be tightly retained therein to releasably connect said spreader arms to said first and second spreaders.

14. The apparatus of claim 13 wherein said couplings each further includes an attachment detent which prevents removal of said first and second spreaders from said engagement portion cavities until said predetermined separation force has been exceeded by the user pulling on said handle with said loop around the object.

15. The apparatus of claim 13 wherein each of said free ends of said spreader arms is formed as a pair of resilient fingers sized to be insertable into one of said engagement portion cavities by yielding movement of said fingers together, and having sufficient resiliency to move said fingers apart once inside said engagement portion cavity to resiliently grasp an interior wall of said engagement portion cavity to prevent removal therefrom until said predetermined separation force is exerted thereon.

16. The apparatus of claim 15 wherein at least one of said fingers of each said spreader arms includes a detent engaging one of said first and second spreaders when said fingers are inserted into said engagement portion cavities.

17. The apparatus of claim 11 further including alignment means for preventing rotation of said first and second spreaders relative to said spreader arms when connected thereto.

18. The apparatus of claim 17 wherein said alignment means includes a recess in each of said first and second spreaders sized to releasably receive therein said free end of one of said spreader arms and having an interior recess wall with a non-symmetrical cross-section and said free ends of said spreader arms having a cross-sectional shape and size to engage said interior wall and prevent rotation of said spreader arms when within said recesses.

19. The apparatus of claim 11 wherein said shaft and said spreader arms are removably attached together, whereby when not in use said handle can be broken down into at least two parts for storage.

20. The apparatus of claim 11 wherein said spreader arms have, in combination, a U-shape with a base portion and said shaft distal end portion is connected to said spreader arms at said base portion.

21. An apparatus to assist a user in tying a boat to an object using a line having a first end portion attachable to the boat, a second end portion forming a loop positionable around the object, and a length of line extending between the first and second end portions, comprising:

first and second spreaders, each said spreader being disconnected from the other and having an aperture through which the second end portion of the line extends to mount said first and second spreaders thereon at opposite sides of the loop; and a handle having a shaft with a proximal end portion for grasping by the user and a distal end portion, and further having a pair of spreader arms, each spreader arm having one end rigidly attached to said shaft distal end portion and a free end spaced apart from said free end of the other of said spreader arms by a predetermined distance, said free end of each of said spreader arms being releasably connectable to a different one of said first and second spreaders with said first and second spreaders positioned to opposite sides of the loop and spaced apart by about said predetermined distance to selectively hold the loop in an open position, said free ends of said spreader arms being selectively disconnectable from said first and second spreaders by the user when the loop is in place around the object to allow the loop to assume a closed position around the object uninhibited by said first and second spreaders or said spreader arms, whereby the user, while located at a distance from the object and holding said proximal end portion of said shaft, can easily place the loop around the object, and the user can selectively disconnect said first and second spreaders from said spreader arms so the loop can assume a closed position around the object for tying the boat to the object.

22. The apparatus of claim 21 wherein said first and second spreaders each has an elongated line retaining portion with first and second longitudinal ends spaced apart by a predetermined amount, and wherein said aperture extends fully between said first and second ends, said spreader arms being oriented relative to each other to hold said line retaining portions in a spaced-apart arrangement with said first ends positioned toward said spreader arms and said second ends positioned away from said spreader arms when said free ends of said spreader arms are connected to said first and second spreaders, whereby the loop is held open in the direction from said first ends to said second ends.

23. The apparatus of claim 22 wherein said first and second spreaders each has an elongated engagement portion having a longitudinally extending cavity with an opening, said free ends of said spreader arms each being an elongated insertion member sized to be inserted into one of said engagement portion cavities and to be tightly retained therein to releasably connect said spreader arms to said first and second spreaders, each of said engagement portions being rigidly connected to one of said line retaining portions.

24. The apparatus of claim 23 further including attachment detent which prevent removal of said first and second spreaders from said engagement portion cavities until a predetermined separation force has been applied by the user pulling on said handle in a direction away from the object with the loop around the object.

25. The apparatus of claim 23 wherein each of said free ends of said spreader arms is formed as a pair of resilient fingers sized to be insertable into one of said engagement portion cavities by yielding movement of said fingers together, and having sufficient resiliency to move said fingers apart once inside said engagement portion cavity to resiliently grasp an interior wall of said engagement portion cavity to prevent removal therefrom until a predetermined separation force has been applied by the user pulling said handle in a direction away from the object with the loop around the object.

26. The apparatus of claim 25 wherein at least one of said fingers of each said spreader arms includes a detent engaging one of said first and second spreaders when said fingers are inserted into said engagement portion cavities.

27. The apparatus of claim 21 further including alignment means for preventing rotation of said first and second spreaders relative to said spreader arms when connected thereto.

28. The apparatus of claim 27 wherein said alignment means includes a recess in each of said first and second spreaders sized to releasably receive therein said free end of one of said spreader arms and having an interior recess wall with a non-symmetrical cross-section and said free ends of said spreader arms having a cross-sectional shape and size to engage said interior wall and prevent rotation of said spreader arms when within said recesses.

29. The apparatus of claim 21 wherein said shaft and said spreader arms are removably attached together, whereby when not in use said handle can be broken down into at least two parts for storage.

30. The apparatus of claim 21 wherein said spreader arms have, in combination, a U-shape with a base portion and said shaft distal end portion is connected to said spreader arms at said base portion.

31. An apparatus to assist a user in tying a boat to an object using a line having a first end portion attachable to the boat, a second end portion forming a loop positionally around the object, and a length of line extending between the first and second end portions and using a handle having an elongated shaft with a proximal end portion for grasping by the user and a distal end portion, comprising:

first and second spreaders, each said spreader being disconnected from the other and having an aperture through which the second end portion of the line extends to independently, slidably mount said first and second spreaders thereon for selected movement of said first and second spreaders to opposite sides of the loop, each said spreader further having a connection recess; and a pair of spreader arms, each spreader arm having one end rigidly attachable to the shaft distal end portion and a free end spaced apart from said free end of the other of said spreader arms by a predetermined distance, said free end of each of said spreader arms being releasably insertable into said recess of a different one of said first and second spreaders with said first and second spreaders positioned to opposite sides of the loop and spaced apart by about said predetermined distance to selectively hold the loop in an open position, said free ends of said spreader arms being releasable from said recesses of said first and second spreaders in response to the user pulling the handle in a direction away from the object with a predetermined separation force with the loop in place around the object to allow the loop to assume a closed position around the object uninhibited by said first and second spreaders or said spreader arms, whereby the user, while located at a distance from the object and holding said proximal end portion of the shaft, can easily place the loop around the object, and the user can selectively disconnect said first and second spreaders from said spreader arms by pulling on the handle so the loop can assume a closed position around the object for tying the boat to the object.

32. The apparatus of claim 31 wherein said first and second spreaders each has an elongated line retaining member with first and second longitudinal ends spaced apart by a predetermined amount, and wherein said aperture extends fully between said first and second member ends, said spreader arms being oriented relative to each other to hold said line retaining members in a spaced-apart, substantially parallel alignment with said first member ends positioned toward said spreader arms and said second member ends positioned away from said spreader arms when said free ends of said spreader arms are inserted within said recesses of said first and second spreaders, whereby the loop is held open in the direction from said first member end to said second member end by at least said predetermined amount.

33. The apparatus of claim 32 wherein said first and second spreaders each has an elongated engagement member with first and second longitudinal ends, said recesses each being a longitudinally extending cavity with an opening at said first engagement member end toward said spreader arms, said free ends of said spreader arms each being an elongated insertion member sized to be inserted into one of said openings of said engagement member cavities and to be tightly retained therein, each of said engagement members being rigidly connected to one of said line retaining members in substantially parallel alignment therewith.

34. The apparatus of claim 31 further including attachment detents which prevent disconnection of said first and second spreaders from said spreader arms until said predetermined separation force has been exceeded by the user pulling on the handle with the loop around the object.

35. The apparatus of claim 31 wherein each of said free ends of said spreader arms is formed as a pair of resilient fingers sized to be insertable into one of said recesses by yielding movement of said fingers together, and having sufficient resiliency to move said fingers apart once inside said recess to resiliently grasp an interior wall of said recess to prevent removal therefrom until said predetermined separation force is exerted thereon.

36. The apparatus of claim 35 wherein at least one of said fingers of each said spreader arms includes a detent engaging one of said first and second spreaders when said fingers are inserted into said recesses.

37. The apparatus of claim 31 further including alignment means for preventing rotation of said first and second spreaders about said spreader arms when inserted in said recesses.

38. The apparatus of claim 37 wherein said alignment means includes said recesses having an interior wall with a non-symmetrical cross-section and said free ends of said spreader arms having a cross-sectional shape and size to engage said interior wall and prevent rotation of said spreader arms when within said recesses.

39. The apparatus of claim 31 wherein said spreader arms are removably attachable to the shaft, whereby when not in use the handle can be separated from said spreader arms for storage.

40. The apparatus of claim 31 wherein said spreader arms have, in combination, a U-shape with a base portion and the shaft distal end portion is attachable to said spreader arms at said base portion.

41. An apparatus to assist a user in tying a boat to an object using a line having a first end portion attachable to the boat, a second end portion forming a loop positionable around the object, and a length of line extending between the first and second end portions and using a handle with a proximal end portion for grasping by the user and a distal end portion, comprising:

first and second spreaders, each said spreader being disconnected from the other and having an aperture through which the second end portion of the line extends to mount said first and second spreaders thereon at opposite sides of the loop; and a pair of spreader arms, each spreader arm having one end rigidly attached to the handle distal end portion and a free end spaced apart from said free end of the other of said spreader arms by a predetermined distance, said free end of each of said spreader arms being releasably connectable to a different one of said first and second spreaders with said first and second spreaders positioned to opposite sides of the loop and spaced apart by about said predetermined distance to selectively hold the loop in an open position, said free ends of said spreader arms being selectively disconnectable from said first and second spreaders by the user when the loop is in place around the object to allow the loop to assume a closed position around the object uninhibited by said first and second spreaders or said spreader arms, whereby the user, while located at a distance from the object and holding the proximal end portion of the shaft, can easily place the loop around the object, and the user can selectively disconnect said first and second spreaders from said spreader arms so the loop can assume a closed position around the object for tying the boat to the object.

42. The apparatus of claim 41 wherein said first and second spreaders each has an elongated line retaining portion with first and second longitudinal ends spaced apart by a predetermined amount, and wherein said aperture extends fully between said first and second ends, said spreader arms being oriented relative to each other to hold said line retaining portions in a spaced-apart arrangement with said first ends positioned toward said spreader arms and said second ends positioned away from said spreader arms when said free ends of said spreader arms are connected to said first and second spreaders, whereby the loop is held open in the direction from said first ends to said second ends.

* * * * *